US005850952A

United States Patent [19]

Morck

[11] Patent Number: 5,850,952

[45] Date of Patent: Dec. 22, 1998

[54] COATED MEANS FOR CONNECTING A CHIP AND A CARD

[75] Inventor: Werner Morck, Hargesheim, Germany

[73] Assignee: Bruno Jesswein Inh. Werner Morck Kunststofftenchnik, Bad Kruznach, Germany

[21] Appl. No.: 669,558

[22] PCT Filed: Jan. 9, 1995

[86] PCT No.: PCT/EP95/00062

§ 371 Date: Oct. 3, 1996

§ 102(e) Date: Oct. 3, 1996

[87] PCT Pub. No.: WO95/19303

PCT Pub. Date: Jul. 20, 1995

[30] Foreign Application Priority Data

| | | | |
|---|---|---|---|
| Jan. 14, 1994 | [DE] | Germany | 44 00 878.3 |
| Mar. 17, 1994 | [DE] | Germany | 44 09 120.6 |
| Nov. 28, 1994 | [DE] | Germany | 44 42 276.8 |
| Nov. 28, 1994 | [DE] | Germany | 44 42 277.6 |
| Nov. 28, 1994 | [DE] | Germany | 44 42 278.4 |

[51] Int. Cl.[6] ..... B67D 3/00

[52] U.S. Cl. ..... 222/530; 222/538

[58] Field of Search ..... 222/530, 538

[56] References Cited

U.S. PATENT DOCUMENTS

| | | | |
|---|---|---|---|
| 4,819,838 | 4/1989 | Hart | 222/538 |
| 5,178,354 | 1/1993 | Engvall | 248/316.7 |

FOREIGN PATENT DOCUMENTS

| | | |
|---|---|---|
| 2381683 | 9/1978 | France . |
| 9209492.9 | 12/1992 | Germany . |

*Primary Examiner*—Gregory L. Huson
*Attorney, Agent, or Firm*—Sheridan Ross P.C.

[57] ABSTRACT

A container having a snapped-in valve adapter is provided according to the invention with the elastic cooperation, upon engagement and disengagement, of an arrow projecting from the tangential plane of the adapter with one of a plurality of recesses disposed on the circumference of the container with the arrowhead in the direction and the opposite direction of the arrow.

16 Claims, 7 Drawing Sheets

ERSATZBLATT (REGEL 26)

COATED MEANS FOR CONNECTING A CHIP AND A CARD

FIELD OF THE INVENTION

This invention relates to a container having a snapped-in valve adapter, and in particular, to a container having a snapped in valve adaptor in which an arrow projects out of a tangential plane of the adaptor and acts elastistically with one of several recesses on the periphery of the container when locking and unlocking.

BACKGROUND AND SUMMARY OF THE INVENTION

Valve adapters according to the invention are used for opening and closing the valve gate disposed in the interior of the valve and reachable with the adapter from outside. In particular the inventive valve adapter is provided with a discharge pipe and a handle. When the handle is operated e.g. the valve gate is opened via a small valve pipe, the so-called valve stem, through which the substrate flows out and thus passes into the adapter pipe. Adapters of this type are used particularly on pressure cans for holding the substrate together in the adapter pipe and discharging it selectively when the valve has been opened. Such adapters frequently have at the outer end of the adapter pipe a clamping joint for an extension pipe which can be slipped on and used for discharging the substrate selectively upon operation of the handle even when the substrate must emerge at a large distance away from the valve. An example of such applications of the invention are polyurethane foams in cans which are used mainly in the construction trade for sealing members.

According to the invention the adapter and valve are produced separately, the adapter being held together with the container in which the substrate is filled until the substrate is to be discharged. This is done in particular with small drums which contain relatively small amounts of substrate and whose valve and adapter must be of relatively simple design. In these and other cases of application of the invention the valve and adapter generally consist of separate plastic parts.

According to the invention the valve adapter has a snap-in locking device which serves to positively connect the adapter temporarily with the container having the valve and containing the substrate so as to guarantee that the adapter is available when the substrate is to be discharged. Such snap-in connections make outer packages superfluous which enclose the parts but are undesirable in the interests of avoiding packaging waste. The inventive snap-in locking device permits the valve adapter to be used several times if only partial amounts of the substrate are consumed and the valve adapter is to be held ready reliably between several of these processes.

When the invention is applied to cans, in particular pressure cans as are used e.g. for polyurethane foams, the gap is expediently provided in the can cap which has up to now served only to cover the valve to exclude untimely actuation of the can valve. Because of their comparatively low value, such and other drums must be finished on fast-working packaging machines. Up to now these have generally been filling machines which output the capped and ready labeled pressure can.

Up to now it has been common practice to have usually female workers unite the can cap with the valve adapter and snap them together by hand. Although this involves considerable labor, known snap-in locking devices cannot be united mechanically, not even when the can is already provided with the cap.

This is impossible in particular with a known valve adapter (DE-GM G 92 09 492.9) which can be connected positively with a can cap with the snap-in locking device. This is because the cap cover has a gap and the edges of the gap form a connecting link guide extending axis-parallel to the can and its cover. The projection serves as a sliding block and must therefore be introduced into the connecting link through the gap in the can cap from above. In a packaging machine this requires a change of direction since the adapter must first be guided radially over the can cap and then introduced axially into the connecting link. Such motions are difficult to realize and furthermore requires the connecting link to be aligned with the sliding block before the sequence of motions begins. Consequently valve adapters with the known snap-in locking device can be connected with the can cap only by hand labor.

In practice a further disadvantage becomes apparent. It consists in that many buyers in self-service stores do not only want to buy the adapter provided with the can cap, but also remove adapters from other can caps to be able to have several adapters. With the known connecting link guide this is easy because the positive locking exists only in the radial direction and the adapter can be readily detached from the can cap by being pushed axially upward.

The invention therefore takes a different path, the basic idea being rendered in claim 1. Further features of the invention are the object of the subclaims.

Since the barbed projection is formed as an arrow preferably aligned perpendicular to the adapter according to the invention, the packaging machine need only perform a radial motion in the direction of the arrow to introduce the adapter into the gap, the adapter being brought up to the can cap in the direction of the arrow with the head of the arrow. As soon as the arrowhead reaches the gap the motion in the direction of the arrow occurs for bending the locking spring, which is unbent after locking. The invention thus permits easier handling for snapping in the adapter and creates the preconditions for replacing hand labor by packaging machines with a high cycle number.

According to the invention the projection of the adapter need no longer be aligned with a certain gap before locking occurs, since the gap is subdivided into a plurality of recesses which can each enter into a snap-in connection with the adapter projection. One can increase the probability of the projection hitting one of the recesses as soon as e.g. a packaging machine brings the adapter with its projection up to the snap-in connection by reducing the recesses so far that the machine will as a rule always hit the snap-in connection. Since a snap-in connection is involved, however, the user can separate the adapter snapped to the container from the adapter any time when he proceeds to discharge the substrate by drawing up the arrowhead to as to overcome the locking spring.

The invention thus provides a machine-compatible design of the snap-in connection which facilitates hand labor and permits the adapter to be snapped to the container in a packaging machine with a corresponding increase in speed and high degree of rationalization.

The arrow is for example largely inflexible and can be made of solid material. According to the features of claim 2 it displaces the edges of the gap by elastic deformation of the material, which returns to its original form behind the arrowhead so that the back of the arrow is seated behind the gap edges which bring about therewith a positive locking of the valve adapter. Conversely, upon release of the snap-in connection the elastic gap edges are urged outward by the back of the arrow, thereby eliminating the positive locking and releasing the valve adapter.

The invention does not only have the advantage of providing favorable preconditions for usual packaging machines, which also pay off for hand labor since it is relatively easy to put the arrow in the gap by hand. It furthermore has the advantage that it can provide closed gaps which achieve a polydirectional positive locking making it difficult for unauthorized persons to separate the adapter from the container, in particular from the can cap.

For this advantage no complicated design of the snap-in connection is needed. It suffices to provide two opposite edges of the gap for displacement upon establishment and upon release of the snap-in connection. It is then advisable to use in particular forms according to claim 4.

For such and other embodiments of the invention it is suitable to use designs of the arrow and the recesses according to claim 5. The rounding of the wedge edge has the advantage that one obtains compact arrow designs which result in a short arrow length, thereby reducing the depth of the gaps without impairing the handling ease of the valve adapter and its simple design. One has the additional advantage that the snapped-in valve adapter cannot be turned around the shaft of the arrow, resulting in a defined alignment of the adapter which, with pressure cans, expediently consists in keeping the extension pipe united with the adapter axis-parallel to the pressure can as soon as the valve adapter is snapped in.

The embodiments of the invention made possible by realizing the features of claim 6 result in a connection of the valve adapter which is practically free from play so that the adapter is held in its predetermined association with the valve or pressure can. This makes it easier to package corresponding drums and hold them ready for sale. This can be obtained in a simple way with the features of claim 7.

With many pressure cans the end of the adapter pipe encloses an angle with the pipe socket slipped on the valve. This is the case in particular with pressure cans filled with a liquid gas for discharging the substrate. In these cases claim 8 permits alignment of the extension pipe with the pressure can for establishing the axis-parallelism.

In most packaging machines the containers are filled and finished upright. For these cases it is advisable to make use of the features of claims 9 and 10. The rotary position of the container relative to the stationary machine unit which stretches forward the adapter with its projection plays no part here. At least one of the recesses is instead hit in any rotary position.

The invention can in particular be applied to pressure cans of the described type expediently according to claim 12. It is then expedient to realize the features of claim 11. Since the recesses are disposed in the valve cap of the pressure can here, no special measures are necessary on the pressure can for providing the relevant parts of the snap-in connection there. The pressure cans can then have the usual smooth metal cylindrical shape.

One will thereby dispose the recesses on the circumference of a radial circle around the axis of symmetry of the container cap, providing them at a relatively small interval in order to guarantee most reliably that the arrow hits a recess when the adapter is stretched forward. The then comparatively thin webs of adjacent recesses serve as springs of the snap-in connection since the material is sufficiently elastic.

The embodiments of the invention are of importance with small drums wherein the adapter is held with its adapter pipe substantially axis-parallel to the axis of symmetry of the container to permit a space-saving packaging and setup of the goods on the shelves of self-service stores, such as building supplies stores. This is another reason why the features of claim 13 are expedient whereby the gaps can form slots whose longer axis extends perpendicular to the radial plane. For in these cases a corresponding profiling of the arrow permits the adapter to be blocked against rotation in the gap.

It also makes it much easier to incorporate the adapter projection in one of the recesses when remaining misalignments are compensated by a corresponding guide which leads the adapter projection into the nearest recess. For this purpose the webs can be profiled with centering slopes for the adapter arrow. This guarantees that each web has a centering slope for both adjacent gaps.

BRIEF DESCRIPTION OF THE FIGURES

The details, other advantages and features of the invention will result from the following description of an embodiment with reference to the figures in the drawing, in which.

DETAILED DESCRIPTION OF THE INVENTION

Figure 1:
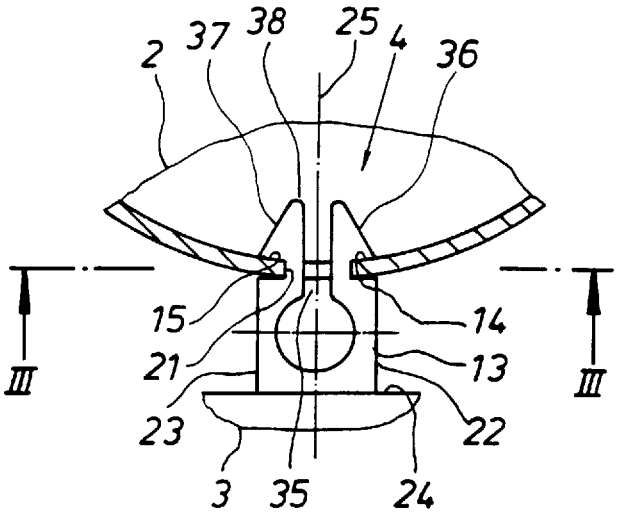
FIG. 1 shows a horizontal section through a broken view of the can cap with the snapped-in valve adapter, which is also shown in a broken view.

The substrate contained in can 1 is under the pressure of a propellant. The can valve is covered with cap 2 mounted on the can cylinder and connected therewith in frictionally engaged and/or positive fashion. The adapter designated in general as 3 can be applied to the valve (not shown) with sleeve 6 of pipe socket 9 and has two handles provided with recessed grips for the fingers of one hand when the adapter is to be used to operate, e.g. tilt, the valve gate in order to free the way for the substrate into adapter pipe 9. Behind pipe 9 following sleeve 6, adapter pipe 3 is bent at 12 so that its free end 11 encloses an acute angle with pipe socket 6, 9. Extension pipe 10 can be slipped on free end 11 of the adapter pipe and is connected therewith in frictional engagement.

Figure 2:
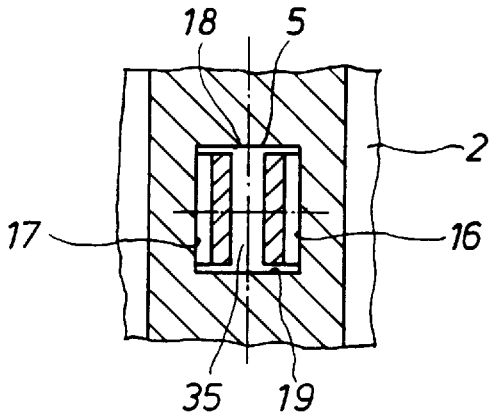
FIG. 2 shows a section along line III—III in FIG. 1.
Figure 3:
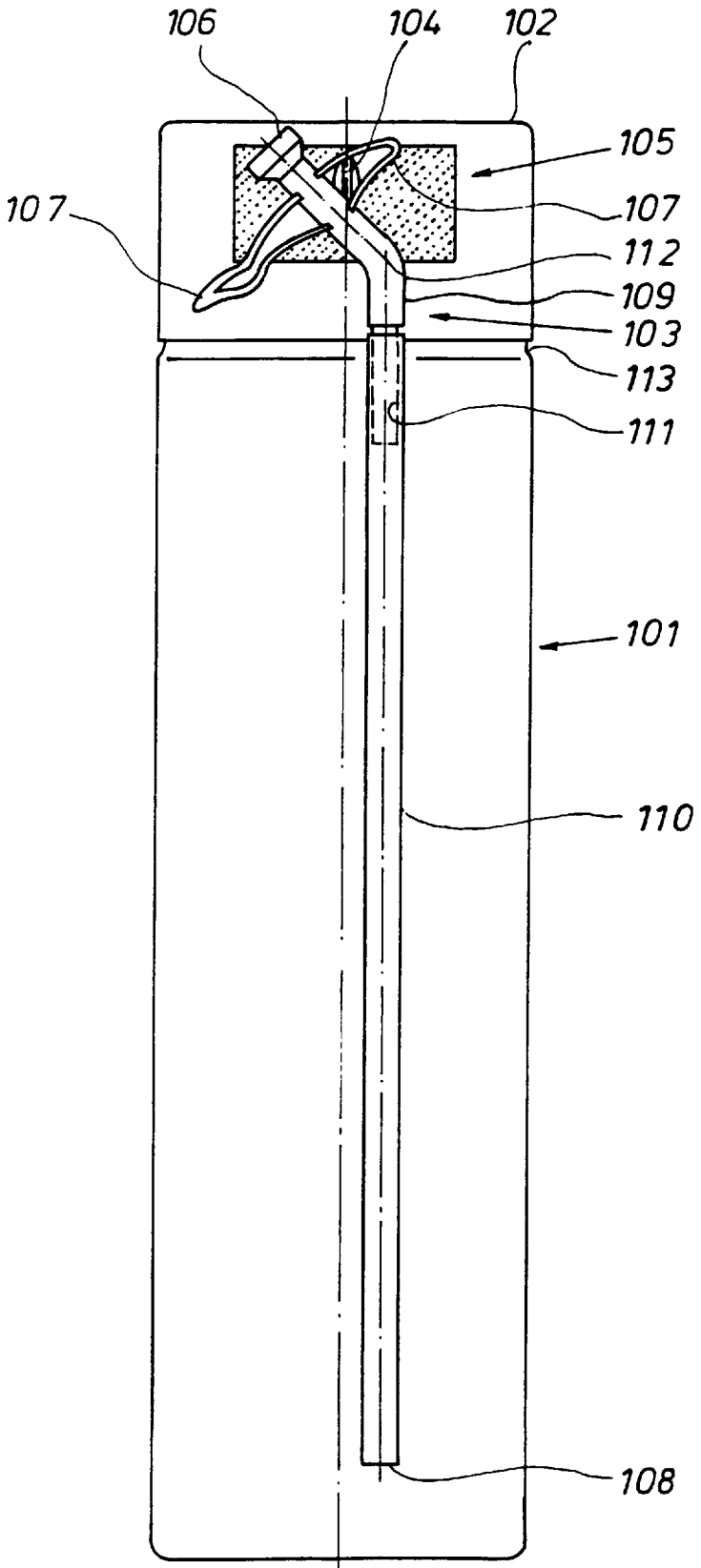
FIG. 3 shows a side view of a pressure can with a snapped-in adapter.

On one of its flanks the adapter has a projection designated as 4 in FIG. 3. This serves as part of a snap-in connection of valve adapter 3 with can cap 2 as apparent in particular from FIGS. 2 and 3.

According to the view in FIG. 1, projection 4 is formed as an arrow aligned perpendicular to the adapter. It accordingly has an arrowhead forming a wedge with two slopes or wedge surfaces 36, 37. The ends of wedge 36, 37 are undercut at 14 and 15, thus forming barbs acting contrary to the direction of the arrow which settle behind edges 16 and 17 of the gap which is designated in general as 5. The gap is rectangular and therefore has upper and lower gap edges 18 and 19 interconnecting vertical edges 16 and 17.

According to the embodiment, arrow shaft 13 is provided with slot-shaped gap 35 penetrating the wedge. The material of projection 4 is elastic and thus forms a spring in which the wedge is incorporated.

When projection 4 is pressed forward into gap 5 with rounded wedge edge 38 in the direction of its described arrow, its arrowhead gives way due to slot 35 when slopes 36, 37 run onto gap edges 16 and 17 so that the material of the arrow is displaced inward and the spring bent. The wedge tip is thereby deformed until undercuts 14 and 15 are located behind the inside jacket of the cap or gap edges 16 and 17. Due to the elasticity of the material the spring is then unbent and gap edges 16 and 17 pass into groove 21 formed by the undercut. The edges of wedge slopes 36, 37 act as barbs contrary to the direction of the arrow, while the rear edge prevents further insertion of the arrow into gap 5 when the positive locking of the snap-in connection is established.

Upon release of the snap-in connection projection 4 is pulled out in the reverse direction of the arrow, whereby the spring of the arrowhead is bent again and slopes 36 and 37 then slide outward on the gap edges until the spring is unbent.

Deviating from the shown embodiment, projection 4 and arrow 13 are made of solid material. In this case gap edges 16 and 17 serve as a spring which is elastically deformed with the arrowhead and the barbs.

As apparent from FIG. 2, the arrow is pointed doubly with slopes disposed in pairs. As apparent from FIG. 3, the barbs formed by undercuts 14 and 15 are located on flat sides 22, 23 of its shaft 13. Consequently shaft 13 of the arrow cannot be rotated around its axis after positive locking is established, as apparent in particular from FIG. 3. This guarantees the position of the adapter relative to the can as apparent from FIG. 1.

The form of the arrow can be simplified further if groove 21 is omitted and undercuts 16 and 17 are followed by a smooth shaft. In this case the distance of undercuts 14 and 15 forming the barbs from the tangential plane to outer rounding 24 of adapter pipe 9 should correspond substantially to the depth of the gap in order to guarantee little radial play between adapter 3 and the can or cap cylinder. One can then prevent the adapter pipe from accidentally assuming an angular position relative to the pressure can.

The center plane of the wedge tip, which is rendered by dash-dot line 25 in FIG. 2, encloses an acute angle with the axis of adapter pipe 9 likewise shown by a dash-dot line in FIG. 1. This guarantees that the snapped-in adapter pipe cannot be swiveled out of its axis-parallel position relative to the can cylinder in the plane of projection of FIG. 1.

Pressure can 101 covers the can valve with can cap 102 mounted on pressure can 101. Adapter 103 can be mounted on the can valve. Cover 102 has recesses 105 to which projection 104 molded on adapter 103 is snapped. The adapter itself has sleeve 106 to be mounted on a discharge pipe of the can valve and connected nonpositively therewith. Recessed grips 107 permit the user to exert pressure on sleeve 106 to open the outlet valve. The substrate contained in the pressure can then flows into following pipe 112 which is bent relative to pipe end 111. Adapter extension pipe 110 can be slipped on pipe end 111 and is held nonpositively thereby. The substrate can then be directed with free end 108 of the adapter selectively even into hidden places like crevices and undercuts.

Figure 4:
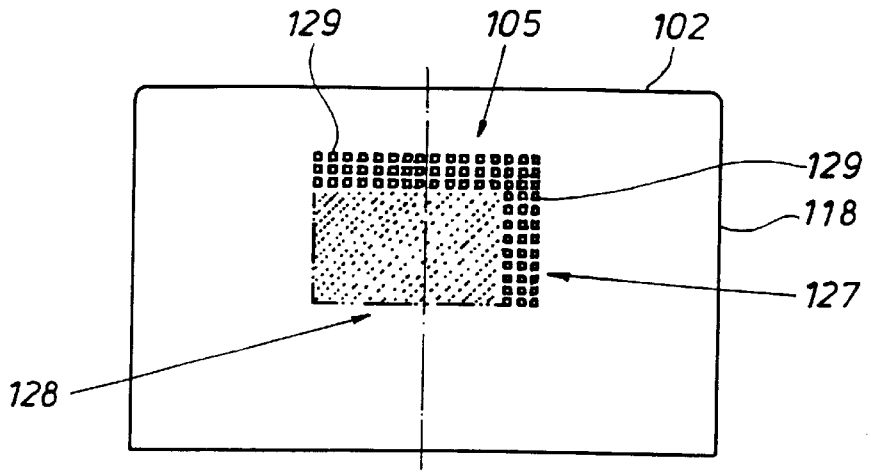
FIG. 4 shows an enlarged view of the pressure can cap of FIG. 3.

According to the embodiment shown in FIG. 3, pressure can 101 has groove 113 running in a radius around the axis of symmetry of the container, which constitutes the longitudinal axis of the container because of the cylindrical shape of the pressure can, said groove being engaged by circumferential inwardly protruding collar 114 when the pressure can cover is properly fitted. In a packaging machine the pressure can cap is mounted mechanically because the material of the pressure can cap gives elastically. The slip-on motion of cap 102 on can 101 is thereby limited with the help of web 116 according to the embodiment of FIG. 3. In the embodiment of FIG. 4 the same purpose is served by circumferential projection 117 in the cover. Recess 105 cooperating with the adapter projection is located in each case above the parts of the cap cooperating with groove 114.

Figure 5:
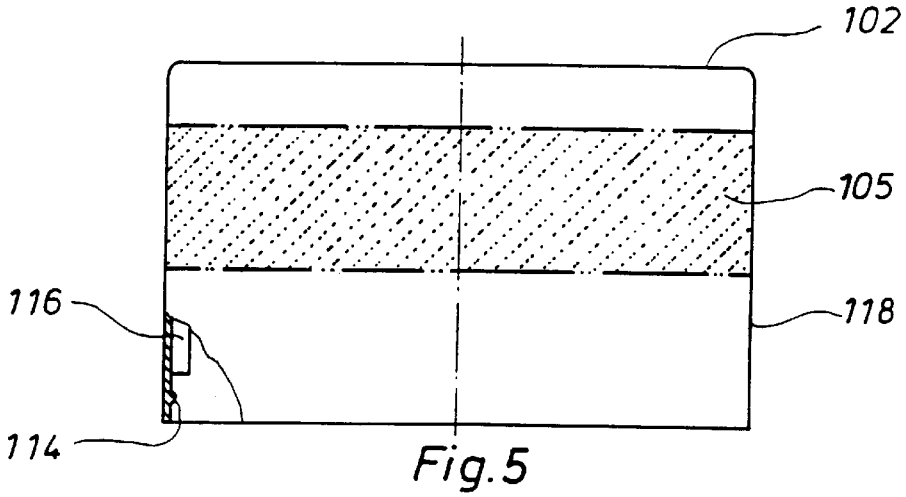
FIG. 5 shows an embodiment modified over FIGS. 3 and 4 in the view corresponding to FIG. 2.
Figure 9:
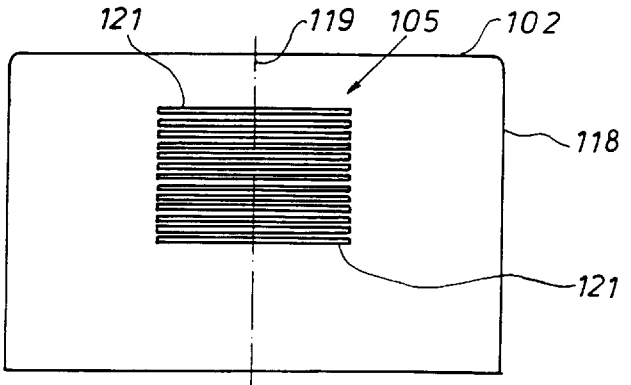
FIG. 9 shows a modified embodiment in the view corresponding to FIGS. 4 to 7.

The embodiments according to FIGS. 4, 8, 9 and 11 all show a plurality of recesses 105 each one of which can enter into a snap-in connection with the adapter projection. In these embodiments, however, recesses 105 are disposed only on part of circumference 118 of cap 102 in an angle range smaller than 90'. The examples in FIGS. 5, 7 and 9 are preferred embodiments of the invention because each cap 102 is distributed along entire circumference 118 of a radial circle around the axis of symmetry of the container and thus of cap 102, so that an angular orientation of recesses 105 relative to the moving direction of the adapter projection is unnecessary.

Figure 6:
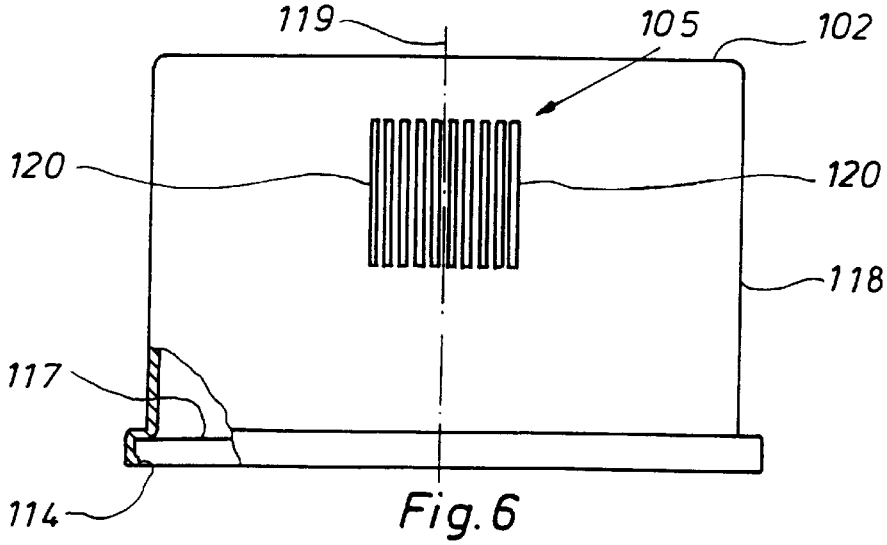
FIG. 6 shows a further embodiment in the view corresponding to FIGS. 3 and 4.

In the embodiment of FIG. 6 recesses 105 of pressure can cap 102 are realized with slots 120. In these cases the closed design of the recesses obtains a polydirectional positive locking so that the adapter projection can be released from the snap-in connection with pressure can cover 102 only by a radial motion. The slots extend parallel to axis of symmetry 119 of cap 102 and thus of the container formed by the pressure can. According to the view in FIG. 9, however, recesses 105 are slots 121 disposed on circumference 118 of cap 102 perpendicular to the axis of symmetry of the cap.

Figure 7:
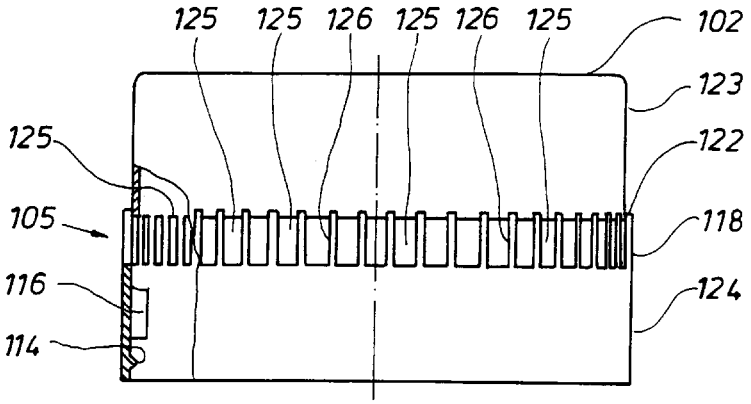
FIG. 7 shows another embodiment in the view corresponding to FIGS. 4 to 6.
Figure 8:
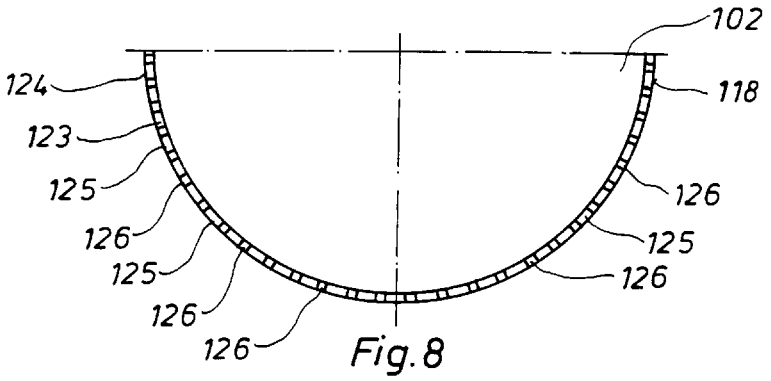
FIG. 8 shows the embodiment of FIG. 7 in a horizontal section and a broken view.

Cap 102 according to the embodiment of FIGS. 7 and 6 is subdivided into two integral cylinders passing into each other at the place designated 122. Smaller-diameter cylinder 123 borders on the bottom of the cap, while greater-diameter cylinder 124 extends from shoulder 122 to the open end of the cap. Shoulder 122 is located in a radial plane of the cap and extends over circumference 118 of the cap. Recesses 105 are located on shoulder 122 in greater-diameter cap cylinder 124. They are likewise formed as slots 125. Their longer axis extends perpendicular to radial plane 118. However the slots end at the beginning of smaller-diameter cap cylinder 123. They thus constitute a connection of the two cap cylinders.

In the embodiment of FIG. 4 the recesses in can cap 102 realize lattice 128. This lattice contains recesses 127 which can be formed as square to circular openings 129 in circumference 118 of cap 102.

Figure 10A:
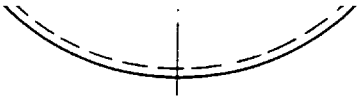
FIGS. 10 and 10*a* show a further modified embodiment in the view corresponding to FIG. 9, FIG. 10*a* showing a top view in the lower drawing.
Figure 10:
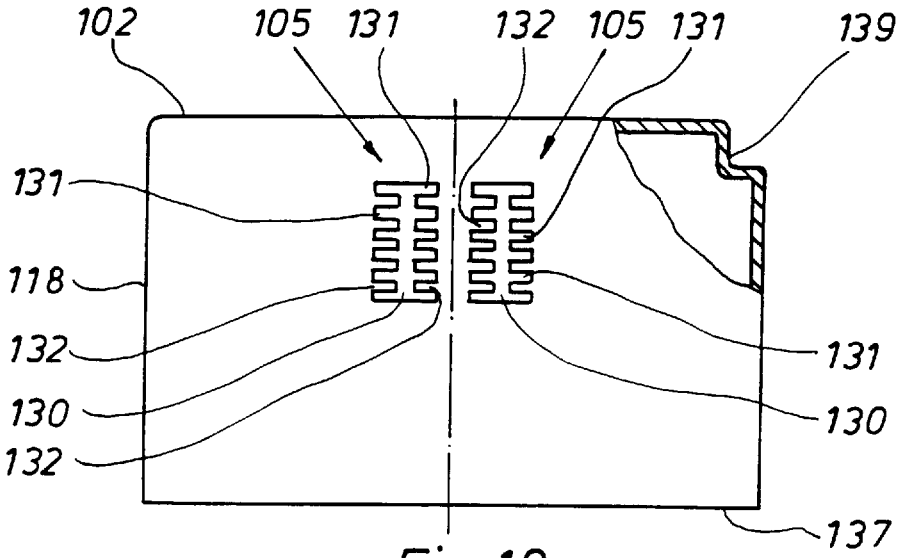
Figure 10A:
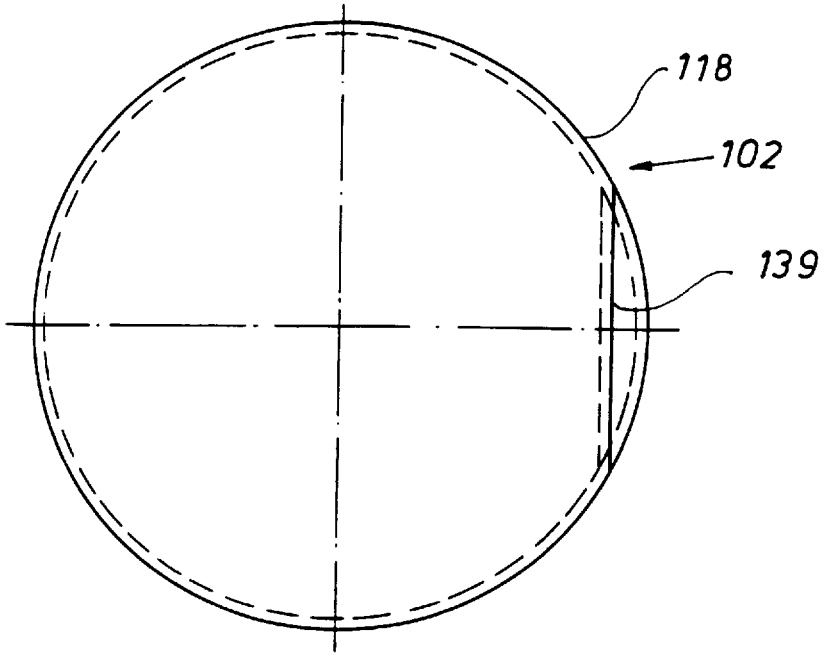

However, recesses 105 of cap 102 in the embodiment of FIG. 10 consist of longitudinal slots 130 forming with corresponding transverse slots 131 a structural unit which is crossed at right angles by longitudinal slots 130. In the crossing area of slots 130 and 131 one obtains the ends of springs 132 which give elastically and guarantee easy snap-in locking of projection 104 on adapter 103 with cap 102.

Figure 11:
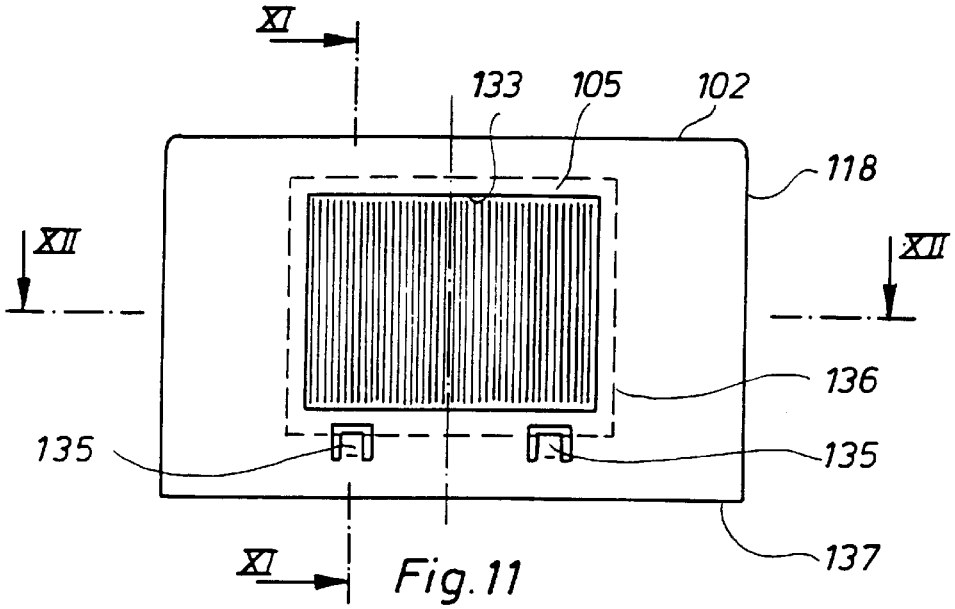
FIG. 11 shows a further modified embodiment according to the invention in a view corresponding to FIGS. 4 to 6.
Figure 12:
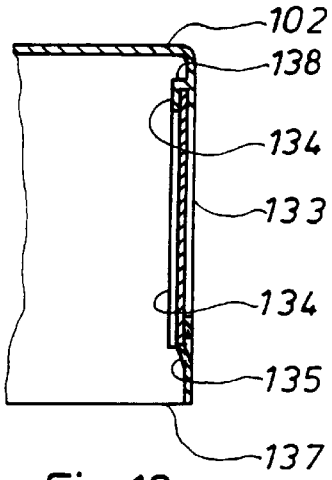
FIG. 12 shows a section along line XI—XI of FIG. 11.
Figure 13:
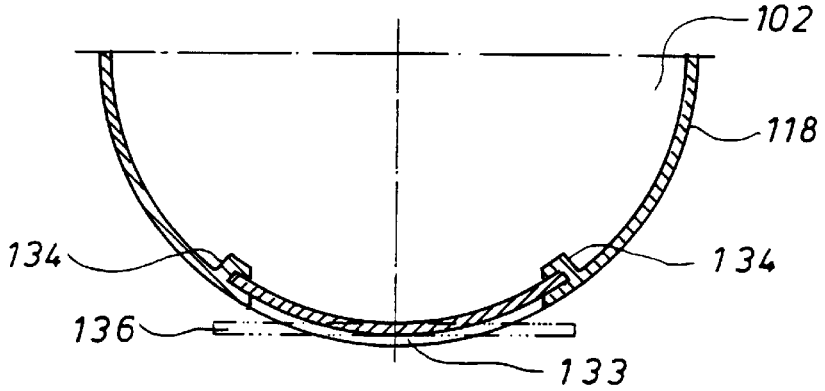
FIG. 13 shows a broken section along line XII—XII of FIG. 11.

In the embodiment of FIGS. 11 to 13 window 133 is set in circumference 118 of cap 102. Guides 134 are molded on the inside of cap 102. These guides are open toward cover opening 137 so that receiving plate 136 can be inserted from this side into guide 134 until it rests in guide bottom 138. Between cap opening 137 and window 133 there are molded-in catches 135 which fix receiving plate 136 in guides 134. Receiving plate 136 bears recesses 105 which are reachable through window 133 for adapter projection 114. Receiving plate 136 can be formed as a flat injection-molded part (cf. FIG. 12) which is elastically deformed before insertion in guide 134.

On circumference 118 of cap 102 one can consequently provide any desired combination of slots 120, 121, 125 and crossing longitudinal and transverse slots 130, 131 and/or openings 129 for receiving projection 104 of adapter 103 to be able to snap different forms of the projection to the same cap 102.

The cap according to FIGS. 10 and 10*a* has on its cover facing away from opening 137 a notch which is used as aligning aid 139 in the packaging machine. Aligning aid 139 is used to align cap 102 for introducing projection 104 disposed on adapter 103 in one of the recesses with sufficient probability.

According to FIGS. 14 to 17 the vertical edges of the recess are beveled and form guiding surfaces 140 with which projection 104 is centered. The two slopes 146, 147 of wedge-shaped arrowhead 141 thereby cooperate with guiding surfaces 140 as soon as wedge tip 141 is moved in the direction of the arrow for locking with can cap 102. The arrowhead is again undercut at 148 and 149, forming barbs with these undercuts. In the snapped-in state barbs 148 and 149 are supported on the associated edges of recess 105. This results in a positive locking of projection 104 with can cap 102, which is eliminated again upon motion of projection 104 in the opposite direction so that the adapter can be separated from can cap 102.

The snap-in lock is therefore based on the spring action of the elastic material. In the case of the embodiment of FIG. 12 the arrowhead itself becomes the spring, whose elasticity is increased by the slot penetrating the wedge in the direction of the arrow and in the opposite direction.

Figure 14:
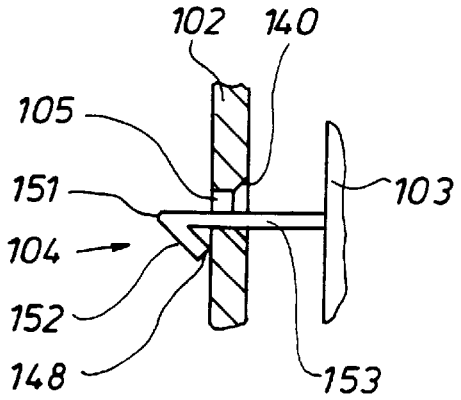
FIG. 14 shows a modified embodiment.

However, in the embodiment of FIG. 14 one-sided arrowhead 151 is provided, spring 152 of arrow 151 consisting of an acute-angled bend of arrow shaft 153. When arrow 153 is pushed into gap 105 in the direction of the arrow, spring 152 is deformed and forms, after crossing gap 105, a barb which is supported on the inside of pressure can cap cylinder 102.

Figure 15:
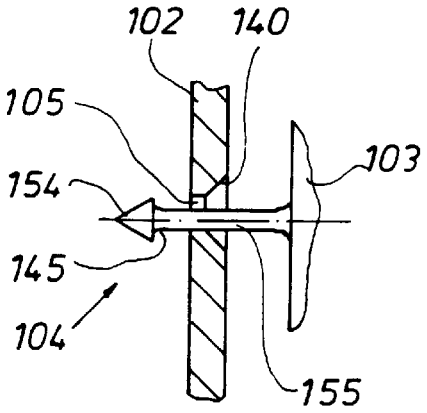
FIG. 15 shows a further embodiment of the adapter projection in the view corresponding to FIG. 13.

In the embodiment of FIG. 15 arrow 154 is formed as a rotational solid, i.e. it has outwardly cylindrical shaft 155 and a conical head forming with undercut 145 a barb which brings about the positive locking with can cap 102, as fundamentally explained above in connection with FIGS. 1 and 2. The springiness necessary for bringing about the positive locking of the snap-in lock can be guaranteed by resiliency of the edges of recess 10S or resiliency of the arrowhead and thus of undercut 145.

Figure 16:
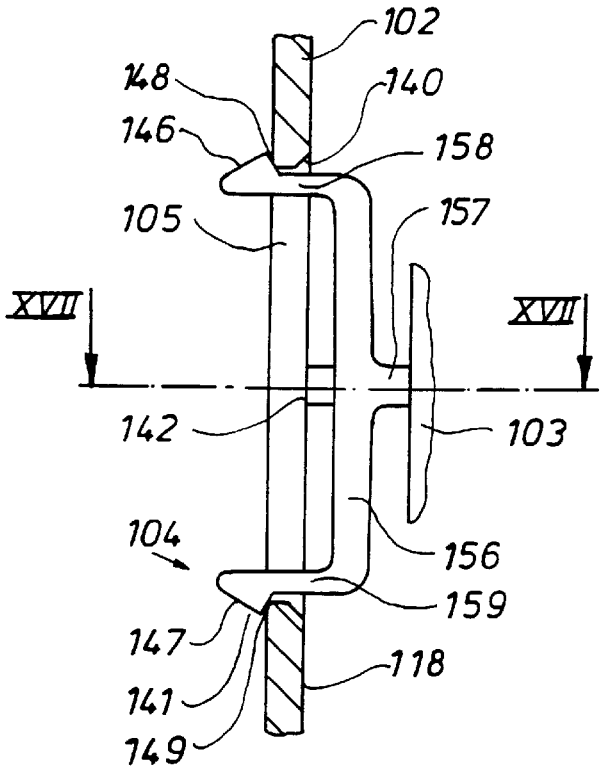
FIG. 16 shows another embodiment substantially according to the view of FIG. 15.
Figure 17:
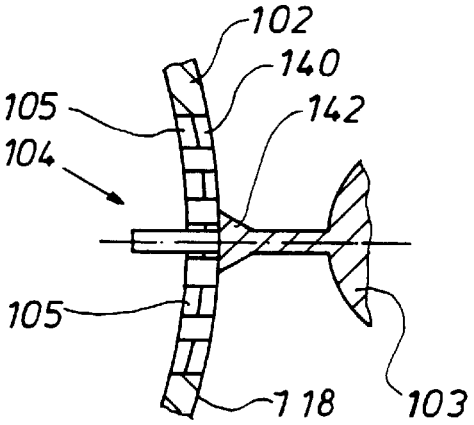
FIG. 17 shows a horizontal section in a broken view along line XVII—XVII of FIG. 16.

The embodiment of FIG. 16 corresponds substantially to the embodiment of FIGS. 1 and 2 with the exception that the wedge surfaces are disposed at the end of forking 156 of arrow shaft 157. The fork prongs ensure the spring action. The snap-in locking takes place here, too, through the resiliency of arrow springs 157 and 158.

As soon as the snap-in locking has occurred, projection 104 is supported on outside cylinder 118 of can cap 102. This is obtained by support 142 molded on projection 104. When the adapter is snapped to can cap 102, support 142 guarantees a strain which fixes the adapter.

I claim:

1. A container having a snapped-in valve adapter comprising:

an arrow projecting out of the tangential plane of the adapter with one of a plurality of recesses disposed on the circumference of the container, said arrow having flat sides and said arrow cooperating elastically upon engagement and disengagement of said adapter with said recesses; and an arrowhead pointed in the direction and the opposite direction of said arrow at the end thereof.

2. The container of claim 1, wherein said arrow is formed as a projection aligned perpendicular to the adapter, wherein said arrowhead elastically widens said recesses in the direction of said arrow upon establishment of a snap-in-connection, said arrowhead of its back doing so upon release of said snap-in connection, there being a positive locking of said arrowhead with mutually opposed gap edges when said snap-in connection is closed.

3. The container of claim 1, wherein said arrowhead is elastically deformable.

4. The container of claim 1, wherein said arrow has wedge-shaped edges and has barbs for establishing a positive lock, said barbs being associated with flat sides of said arrow, said wedge-shaped edges being rounded.

5. The container of claim 1, wherein said arrow has an arrow shaft which has a cross section, said cross section of said arrow shaft and the contour of said recesses being coordinated in such a way that said valve adapter is rotationally fixed after establishment of said snap-in connection.

6. The container of claim 2, wherein said container has front and back gap edges, there being a positive locking of said back gap edges and said front gap edges with said adapter after establishment of said snap-in lock.

7. The container of claim 4, wherein said arrowhead has extended wedge flanks which form barbs whose distance from the tangential plane to the outer rounding of an adapter pipe corresponds substantially to the depth of said gap.

8. The container of claim 7, wherein coaxial alignment of said adapter with said containers the center plane of the wedge tips and/or of said arrow shaft cross sections encloses an acute angle with the axis of said adapter pipe relative to which said adapter is bent.

9. The container of claim 1, wherein said plurality of recesses are formed as a snap-in connection with said projection of said adapter.

10. The container of claim 1, wherein said recesses are disposed side by side on a common radial plane through the axis of symmetry of said container and penetrate a cylinder surface, the webs of adjacent recesses serving as springs of said snap-in connection and enclosing slots whose longer axis extends perpendicular to said radial plane.

11. The container of claim 10, wherein said webs are profiled in trapezoidally symmetric fashion with centering slopes for a projection of said adapter, said shorter trapezoid side being oriented outward.

12. The apparatus of claim 10, wherein said recesses are provided in a valve cap of a pressure can wherein said cap has an at least partly circumferential transition subdividing said transition from a smaller cap cylinder bordering on said cover of said cap to a greater cap cylinder reaching as far as a cap opening, said greater cylinder having slots at said transition of said greater cap cylinder and said smaller cap cylinders and said webs starting between said slots on said greater cap cylinder and ending in said smaller cap cylinder.

13. The apparatus of claim 12, wherein said recesses are provided on a fraction of said circumference of said cap and said cap has an aligning aid.

14. The apparatus of claim 12, wherein said recesses in said cover of said cap consist of a longitudinal slot and at least one transverse slot crossing said longitudinal slot.

15. The apparatus of claim 12, wherein a window is set on said circumference of said cap, said window being covered with a receiving plate disposed in guides and fixed with catches, said receiving plate having said recesses.

16. The apparatus of claim 1, wherein said recesses consist of slots and longitudinal and transverse slots crossing said slots, and/or holes.

* * * * *